US005305176A

United States Patent [19]

Hirota

[11] Patent Number: 5,305,176

[45] Date of Patent: Apr. 19, 1994

[54] INDUCTIVE LOAD DRIVE CIRCUIT

[75] Inventor: Yoshihiro Hirota, Tokyo, Japan

[73] Assignee: NEC Corporation, Tokyo, Japan

[21] Appl. No.: 774,720

[22] Filed: Oct. 9, 1991

[30] Foreign Application Priority Data

Oct. 12, 1990 [JP] Japan ..... 2-274789

[51] Int. Cl.[5] ..... F02P 3/00

[52] U.S. Cl. ..... 361/205; 361/91; 361/111

[58] Field of Search ..... 361/152, 155, 156, 160, 361/205, 91, 111

[56] References Cited

U.S. PATENT DOCUMENTS 4,128,091 12/1971 Balan et al. ..... 123/148 E
4,318,155 3/1982 Thomas ..... 361/156
4,516,184 5/1985 Tominari ..... 361/152
4,562,506 12/1985 Moran ..... 361/71
5,016,135 5/1991 Zylstra ..... 361/156

FOREIGN PATENT DOCUMENTS 2833343 2/1980 Fed. Rep. of Germany .
2833477 2/1980 Fed. Rep. of Germany .

*Primary Examiner*—Jeffrey A. Gaffin

[57] ABSTRACT

An inductive load drive circuit includes a transistor having a collector and emitter current path interposed between an inductive load and a constant current source, and a feedback circuit. The feedback circuit has a Zener diode and a resistor which are connected with each other in series. The feedback circuit is connected between the collector and the base of the transistor. A speed-up capacitor is connected in parallel with the resistor and in series with the base of the transistor.

3 Claims, 3 Drawing Sheets

INDUCTIVE LOAD DRIVE CIRCUIT

BACKGROUND OF THE INVENTION

1. Field of the invention

The present invention relates to an inductive load drive circuit and in particular to a drive circuit which is coupled with an inductive load such as an ignition system of a vehicle for generating a high voltage.

2. Prior Art

As shown in FIG. 1, such a conventional drive circuit 300 is connected with a controller 100 comprising a current source 101 and a switch 102 via a harness 103 and comprises an NPN power transistor 1 having an emitter which is grounded, a series-connected resistors 3 and 4 having an intermediate connection which is connected with the base of the power transistor 1 and a Zener diode 2 interposed between the resistor 3 and the collector of the power transistor 1. The resistor 4 is provided for preventing any malfunction due to leaked current. The collector of the power transistor 1 is connected with the primary coil of an ignition coil 202 which is an inductive load 200. The secondary coil of the ignition coil 202 is connected with an ignition plug (not shown).

Operation of this prior art drive circuit will be described with reference to FIG. 2A. When the switch 102 is closed at the time t1, a drive current is supplied to the power transistor 1 from the current source 101 via the switch 102 and the harness 103. Accordingly, a collector current of the power transistor 1 increases for a period of time T1 since the time t1. When the switch 102 is turned off at the time t2, the collector current suddenly descreases for a period of time T2. The collector current never flows for a period of time T3 following the period of time T2.

The period of time T2 is a period of time for which the power transistor 1 is brought into a completely non-conductive state after it has been brought into a conductive state once since the switch 102 is turned off. In response to a rapid change in the collector current, a high collector voltage of the power transistor 1 is generated across the primary coil of the ignition coil 202.

A waveform of the collector voltage for the period of time T2 is shown in detail in FIG. 2B. When the collector voltage abruptly rises up to exceed the voltage $V_z$ of on of the Zener diode 2, a feed back current IFB is supplied to the base of the power transistor 1 from the Zener diode 2 via the resistor 3. The feed back current turns the power transistor 1 on so that the collector voltage settles to a constant value $V_{CL}$. The voltage value $V_{CL}$ is expressed as follows:

$$V_{CL}=VZ+R3\times IFB$$

wherein R3 represents the resistance of the resistor 3.

In order to generate a high voltage across the primary coil of the ignition coil, the power transistor 1 is turned on or off for a short period of time T2 in the prior inductive load drive circuit. The collector current increases to an overvoltage Vp which is higher than the stable voltage $V_{CL}$ for a period of time $\tau$ since the time t2. This is due to a fact that the feed back current charges the distributed capacitance on the base line of the power transistor 1 (for example, the base parasitic capacitance of the power transistor 1, parasitic capacitance of the harness 103, etc.) so that the power transistor 1 is maintained non-conductive for a period of time $\tau$. The collector voltage increases to an overvoltage in accordance with a relation L×d (collector current)/dt.

Therefore, there has been a problem that as the controller 100 is so remote from the drive circuit 300 that the length of the harness 103 is long, the period of time $\tau$ is extended and the overvoltage Vp increases to such a value that it breaks the power transistor 1.

SUMMARY OF THE INVENTION

Accordingly, it is an object of the present invention to provide a reliable inductive load drive circuit which is capable of suppressing an overvoltage Vp.

An inductive load drive circuit of the present invention includes a transistor having a collector and emitter current path interposed between an inductive load and a constant current source; and a feed back circuit having a Zener diode and a resistor connected with each other in series, which is connected between the collector and the base of said transistor, wherein a speed-up capacitor is connected in parallel with the resistor.

In the inductive load drive circuit, a diode may be interposed between an external controller for supplying a drive current to the transistor and the base of the transistor so that the cathode of the diode is connected with the base side of the transistor.

Since the speed-up capacitor quickly charges the base parasitic capacitance when a current is supplied to the base of the power transistor via the feed back circuit, the thus formed inductive load drive circuit can turn the transistor on at a high speed.

Furthermore, since interposition of the diode decreases the parasitic capacitance which is added to the feed back circuit, the switching speed of the transistor can be further improved.

DESCRIPTION OF THE PREFERRED EMBODIMENT

Embodiments of the present invention will be described with reference to the drawings.

Figure 1:
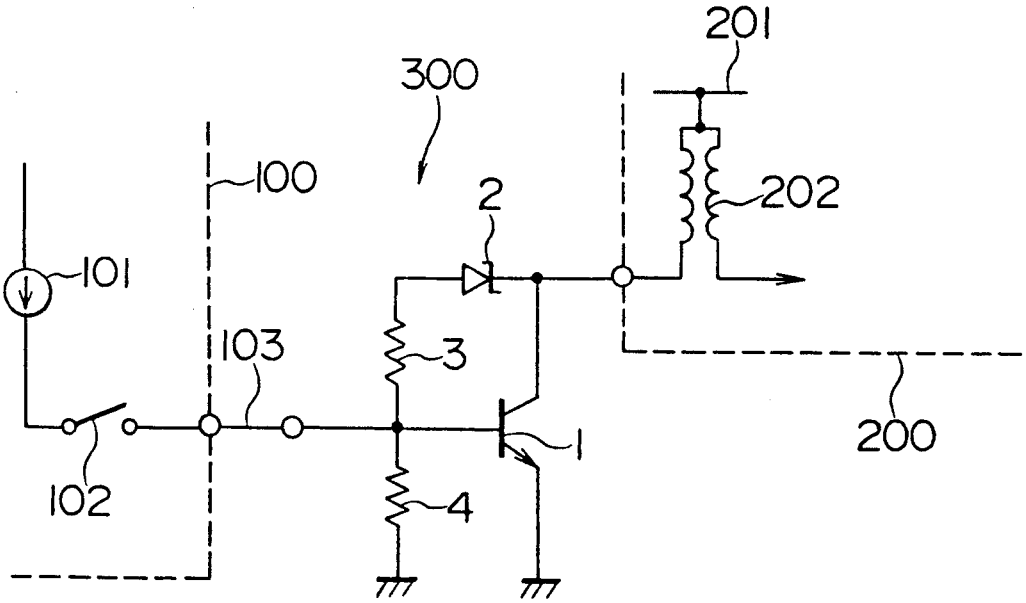
FIG. 1 PRIOR ART
FIG. 1 is a circuit diagram of a prior art.
Figure 2A:
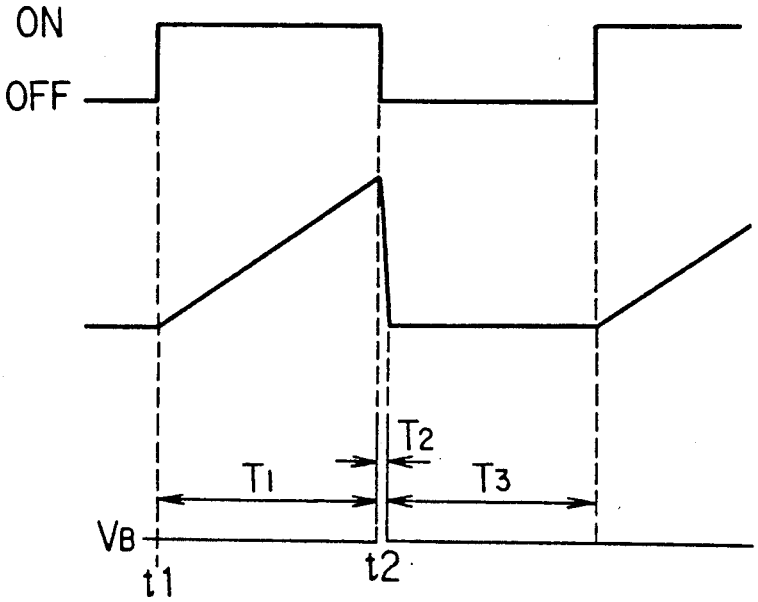
FIG. 2A PRIOR ART
FIG. 2A is a timing chart of the prior art.
Figure 2B:
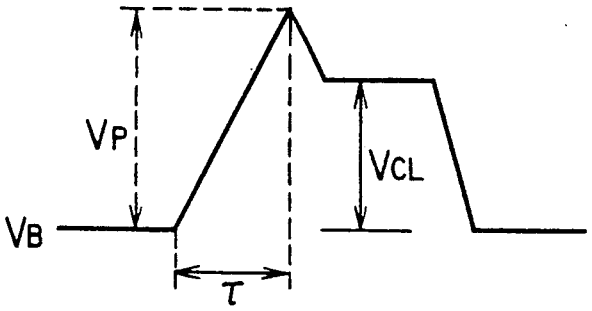
FIG. 2B PRIOR ART
FIG. 2B is an enlarged timing chart showing the period of time T2.
Figure 3:
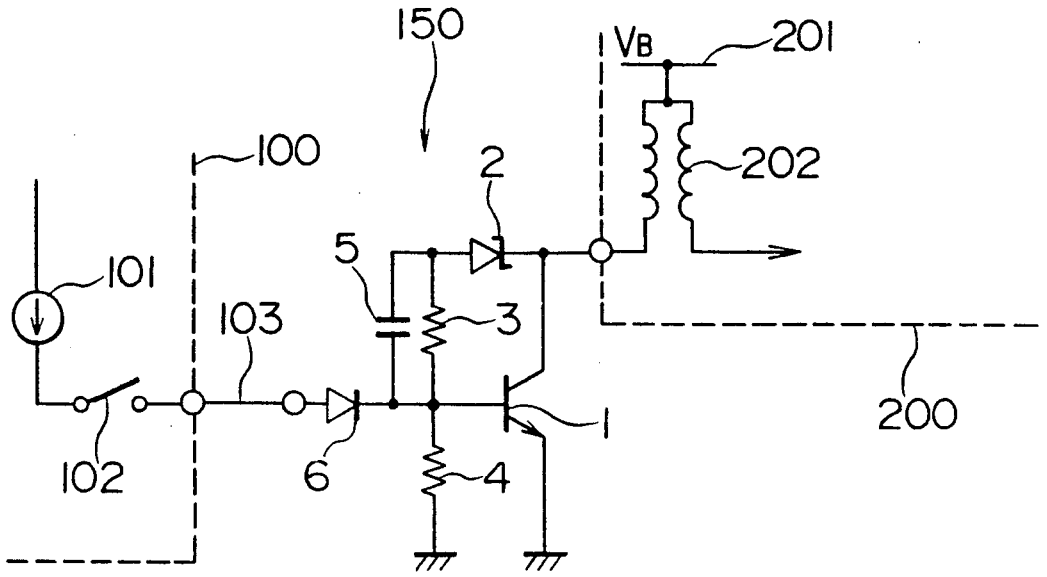
FIG. 3 is a circuit diagram showing a first embodiment of the present invention.

Referring now to FIG. 3, there is shown an inductive load drive circuit 150 which is a first embodiment of the present invention. Since components of the first embodiment which are like to those of the prior art are designated by like reference numerals, explanation of like components will be omitted herein. The inductive load drive circuit 150 shown in FIG. 3 comprises a capacitor 5 which is connected in parallel with the resistor 3 and a diode 6 having anode and cathode which are connected with the harness 103 and the base of the power transistor 1, repectively.

Now, operation of the first embodiment will be described. The switch 102 is closed and a drive current is supplied to the power transistor 1 from the current source 101 via the switch 102, the harness 103 and the diode 6. When the switch is opened again, a high voltage is generated across the primary coil of the ignition coil 202. The foregoing process is identical with that in the prior art.

The feature of the present embodiment resides in that when the Zener diode 2 is turned on the power transistor 1 is immediately biased to a conductive state, as explained herein below. That is, since the diode 6 is interposed between the harness 103 and the base of the power transistor 1 even if the Zener diode 2 is turned on and a feed back current IFB begins to flow, it is not necessary to charge the parasitic capacitance of the harness 103. Since the capacitor 5 quickly charges the base parasitic capacitance of the power transistor 1, the power transistor 1 is immediately brought into the conductive state. Accordingly, the time $\tau$ can be considerably shortened so that the overvoltage Vp can be suppressed. As a result of this, the power transistor 1 is capable of stably functioning independently of the distance between the controller 100 and the drive circuit 150.

Figure 4:
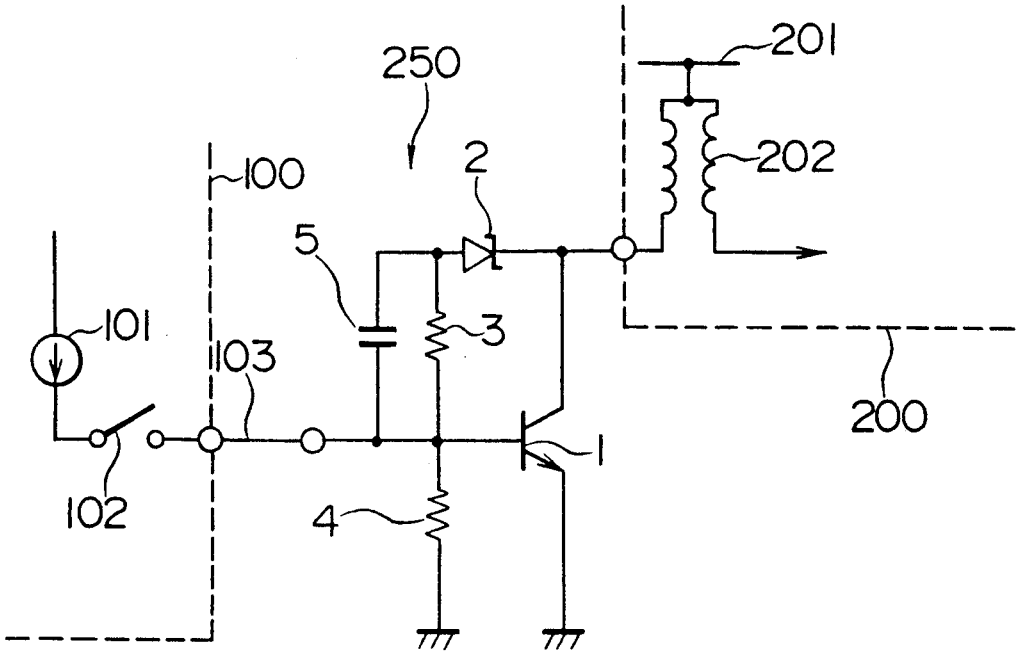
FIG. 4 is a circuit diagram showing a second embodiment of the present invention.

Referring now to FIG. 4, there is shown an inductive load drive circuit 250 which is a second embodiment of the present invention. The second embodiment is identical with the first embodiment except that the diode 6 interposed between the harness 103 and the base of the power transistor 1 as shown in FIG. 3, is removed. Since the capacitance of the capacitor 5 is increased to about 100 to 300 pF in the second embodiment, the capacitor 5 quickly charges all parasitic capacitances. If the capacitance of the harness 103 will not be largely changed on the applied positions, increasing the capacitance of the capacitor 5 will shorten the period of time $\tau$ so that the overvoltage Vp can be suppressed.

As mentioned above, the switching speed of the transistor can be enhanced so that the overvoltage of the collector can be suppressed in accordance with the present invention since a speed-up capacitor is provided in parallel with a resistor. Therefore, breaking down of the transistor due to the overvoltage can be prevented so that the transistor can be stably functioned.

What is claimed is:

1. An inductive load drive circuit including a transistor having a collector and emitter current path interposed between and inductive load and a constant current source;

a feed back circuit including a Zener diode and a resistor which are in series connected with each other, said feed back circuit being connected between the collector and the base of said transistor; and speed-up capacitor connected in parallel with the resistor, said speed-up capacitor being in series connected with a base-emitter of said transistor so as to enable said transistor to suppress overvoltage in said collector when a high voltage is generated across said inductive load.

2. An inductive load drive circuit as defined in claim 1, in which a diode is interposed between an external controller for supplying a drive current to the transistor and the base of the transistor so that the cathode of the diode is connected with the base side of the transistor.

3. An inductive load drive circuit as defined in claim 1, in which the capacitance of the speed-up capacitor is about 100 to 300 pF.

* * * * *